US007010833B2

(12) United States Patent
Duarte et al.

(10) Patent No.: US 7,010,833 B2
(45) Date of Patent: Mar. 14, 2006

(54) SLIDE HINGE FOR SPA COVER

(76) Inventors: Carlos Duarte, 906 W. Donington St., Glendora, CA (US) 91741; Fred S. Romero, 19637 Golden Bough, Covina, CA (US) 91724

( * ) Notice: Subject to any disclaimer, the term of this patent is extended or adjusted under 35 U.S.C. 154(b) by 2 days.

(21) Appl. No.: 10/622,198

(22) Filed: Jul. 18, 2003

(65) Prior Publication Data

US 2005/0011048 A1 Jan. 20, 2005

(51) Int. Cl.
*E05D 11/06* (2006.01)

(52) U.S. Cl. ..... 16/358; 16/362; 16/364; 4/498

(58) Field of Classification Search ..... 16/357, 16/358, 362, 364, 372, 242, 243; 49/57, 49/463, 465; 312/325, 327, 328; 4/498, 4/494, 236, 240, 500, 503, 394; 220/263, 220/811, 812, 813
See application file for complete search history.

(56) References Cited

U.S. PATENT DOCUMENTS

| | | | | |
|---|---|---|---|---|
| 586,476 A | | 7/1897 | Coates | |
| 1,068,391 A | | 7/1913 | Jensen | |
| 1,115,345 A | | 10/1914 | Steuernagel | |
| 1,115,465 A | | 10/1914 | Goddin | |
| 2,338,477 A | * | 1/1944 | Wolters et al. | 220/812 |
| 2,376,966 A | | 5/1945 | Ingerman | |
| 2,516,196 A | | 7/1950 | Fowler | |
| 2,551,305 A | | 5/1951 | Tompkins | |
| 2,590,028 A | | 3/1952 | Miller | |
| 2,634,074 A | * | 4/1953 | Von Allmen | 248/147 |
| 2,648,516 A | | 8/1953 | Manetti et al. | |
| 2,689,101 A | | 9/1954 | Dygert | |
| 2,793,387 A | | 5/1957 | Odell | |
| 2,840,847 A | | 7/1958 | Danser | |
| 2,853,352 A | | 7/1958 | Gittins | |
| 3,001,225 A | | 9/1961 | Squire | |
| 3,038,196 A | | 6/1962 | Nyquist | |
| 3,261,051 A | | 7/1966 | Priest | |
| 3,351,975 A | | 11/1967 | Goto | |
| 3,539,239 A | | 11/1970 | Mallonn | |
| 3,961,723 A | * | 6/1976 | Eckel | 220/812 |
| 4,076,203 A | | 2/1978 | McDonnell | |

(Continued)

FOREIGN PATENT DOCUMENTS

CH 672459 A5 * 11/1989

(Continued)

OTHER PUBLICATIONS

The Ideal Lift with Installation Instruction for the Ideal Cover Lift; http://www.rhtubs.com/coverlifts/ideal-lift.htm and http://www.rhtubs.com/coverlifts/ideal-lift-instructions.htm; 7 pages.

(Continued)

*Primary Examiner*—Chuck Y. Mah
*Assistant Examiner*—Michael J. Kyle
(74) *Attorney, Agent, or Firm*—Christie, Parker & Hale, LLP

(57) ABSTRACT

A hinge assembly for coupling a spa cover to a spa includes a mounting bracket, a slide bracket and a support arm adapted to be attached to the spa cover. The mounting bracket is adapted to be installed near a top of the spa. The slide bracket is slidably coupled to the mounting bracket. The support arm is pivotably coupled to the slide bracket at a pivot point on the slide bracket. A metal plate may be affixed using a double sided tape on an outside surface of the spa cover, and then anchored to the spa cover. The metal plate may be used to attach the support arm to the spa cover.

8 Claims, 8 Drawing Sheets

U.S. PATENT DOCUMENTS

| | | | | | |
|---|---|---|---|---|---|
| 4,167,298 | A | | 9/1979 | Plattner | |
| 4,223,420 | A | | 9/1980 | Yukimoto et al. | |
| 4,383,721 | A | | 5/1983 | Knaack et al. | |
| D278,010 | S | | 3/1985 | Ostrander | |
| 4,853,985 | A | | 8/1989 | Perry | |
| 4,857,374 | A | | 8/1989 | Perry | |
| 4,878,596 | A | * | 11/1989 | Cawley et al. | 220/812 |
| 4,893,863 | A | | 1/1990 | Skonieczny et al. | |
| 4,899,420 | A | | 2/1990 | Bye et al. | |
| 4,953,259 | A | | 9/1990 | Frye et al. | |
| 4,953,985 | A | | 9/1990 | Miller | |
| 4,966,403 | A | | 10/1990 | Nordström | |
| 4,991,238 | A | | 2/1991 | Forrest | |
| 5,027,473 | A | | 7/1991 | Hottmann | |
| 5,048,153 | A | | 9/1991 | Wall et al. | |
| 5,050,943 | A | | 9/1991 | Barnett | |
| 5,131,102 | A | | 7/1992 | Salley et al. | |
| 5,172,969 | A | | 12/1992 | Reuter et al. | |
| 5,409,308 | A | | 4/1995 | Reuter et al. | |
| 5,471,685 | A | * | 12/1995 | Cross | 4/500 |
| 5,517,703 | A | | 5/1996 | Ouelette | |
| 5,566,403 | A | | 10/1996 | Black et al. | |
| 5,584,081 | A | | 12/1996 | Ouelette | |
| 5,634,218 | A | | 6/1997 | Ouelette | |
| 5,644,803 | A | | 7/1997 | Wilson | |
| 5,689,841 | A | | 11/1997 | Black et al. | |
| 5,819,332 | A | | 10/1998 | Perry | |
| 5,847,374 | A | | 12/1998 | Menconi | |
| 5,896,619 | A | | 4/1999 | Koopman | |
| 5,904,411 | A | | 5/1999 | Hayakawa | |
| 5,950,252 | A | | 9/1999 | Fettes | |
| 5,974,599 | A | | 11/1999 | Tudor | |
| 5,974,600 | A | | 11/1999 | Pucci et al. | |
| 5,996,137 | A | | 12/1999 | Genova | |
| 6,000,071 | A | | 12/1999 | Fettes | |
| 6,000,072 | A | | 12/1999 | LaHay | |
| 6,032,305 | A | | 3/2000 | Tedrick | |
| 6,045,173 | A | * | 4/2000 | Tiesler et al. | 296/37.8 |
| 6,139,236 | A | * | 10/2000 | Ito | 411/30 |
| 6,158,063 | A | | 12/2000 | Tudor | |
| 6,195,811 | B1 | | 3/2001 | Dragovic | |
| 6,381,766 | B1 | | 5/2002 | Perry | |
| 6,393,630 | B1 | | 5/2002 | Tedrick | |
| 6,423,899 | B1 | * | 7/2002 | Reiker | 174/58 |
| 6,442,799 | B1 | | 9/2002 | Duarte et al. | |
| 2002/0050003 | A1 | | 5/2002 | Perry | |

FOREIGN PATENT DOCUMENTS

| | | |
|---|---|---|
| FR | 2091715 | 1/1972 |
| FR | 2089842 | 7/1972 |

OTHER PUBLICATIONS

The Cover Valet with Installation Instructions for the Cover Valet; http://www.rhtubs.com/coverlifts/cover-valet.htm and http://www.rhtubs.com/coverlifts/cover-valet-instructions.htm; 6 Pages.

Ideal E-Z Lifter with Installation Instructions for the E-Z Lifter; http://www.rhtubs.com/coverlifts/EZlifter.htm and http://www.rhtubs.com/coverlifts/EZlifter-instructions.htm; 9 Pages.

Covermate I and Installation Instructions for the Covermate I; http://www.rhtubs.com/coverlifts/cover-mate1.htm and http://www.rhtubs.com/coverlifts/covermate1-%20instructions.htm; 7 Pages.

Covermate II with Installation Instructions for the Covermate II; http://www.rhtubs.com/coverlifts/cover-mate2.htm and http://www.rhtubs.com/coverlifts/covermate2-instructions.htm; 10 Pages.

Covermate III with Installation Instructions for the Covermate III; http://www.rhtubs.com//coverlifts/cover-mate3htm and http://www.rhtubs.com/coverlifts/covermate3-instructions.htm; 7 Pages.

HotSpring Portable Spas, Virtual Showroom, http://www.hotspring.com/Virtual/accessories.html, http://www.hotspring.com/Virtual/jpgs/gliderite_full.jpg, http://www.hotspring.com/Built/jpgs/reg_cover_closed.jpg, and http://www.hotspring.com/Virtual/jpgs/uprite.jpg, 5 Pages.

Franz, Hettich K.G., Germany, The Complete Häfele, Swing-Up Fittings, Jul. 1998, pp. 5.30-5.31.s.

Sanderfoot, Alan E, Rising to the Occasion, AQUA Magazine, Jun. 1996.

Tubcap by CEnTech Corporation (8 pages).

* cited by examiner

SLIDE HINGE FOR SPA COVER

CROSS-REFERENCE TO RELATED APPLICATION(S)

This application includes subject matter related to U.S. patent application Ser. No. 10/622,213 filed on the even date herewith, the contents of which are incorporated by reference herein.

FIELD OF THE INVENTION

This application is related to a hinge between spa and spa cover, and more particularly, to a hinge assembly that allows the spa cover to be slid first and then rotated to open the spa.

BACKGROUND

Commercially available spas typically have a spa cover to prevent dirt or dust from entering therein. To open the spa, a spa cover is typically folded in half, hingedly lifted off the top of the spa, and lowered vertically behind the spa so as to reduce its obstruction of view to a person using the spa. The spa cover is typically lifted off the top of the spa in one continuous motion. This typically requires a lot of strength, and such opening of spa is often assisted by a spring member, such as a gas spring.

There are some spa opening mechanisms that do not incorporate a spring member. The spa cover removal apparatus disclosed in U.S. Pat. No. 6,381,766 issued to Perry ("the '766 patent") discloses one such spa opening mechanism that is not assisted by a spring. The '766 patent discloses that a spa cover shifts from a first horizontal covering position over the spa to a second stowed position adjacent to the back side of the spa as a rearwardly directed force is applied to the spa cover. According to the '766 patent, the spa cover moves rearward and pivots relative to the side arms while the pivot frame assembly simultaneously pivots relative to the stationary base, about a substantially horizontal base pivot axis.

SUMMARY

In an exemplary embodiment according to the present invention, a hinge assembly for coupling a spa cover to a spa is provided. The hinge assembly includes: a mounting bracket adapted to be installed near a top of the spa; a slide bracket slidably coupled to the mounting bracket; and a support arm adapted to be attached to the spa cover, wherein the support arm is pivotably coupled to the slide bracket at a pivot point on the slide bracket.

In another exemplary embodiment according to the present invention is provided a spa system that includes: a spa; a foldable spa cover having at least two sections; a hinge assembly for coupling the spa cover to the spa, said hinge assembly including: a mounting bracket adapted to be installed near a top of the spa; a slide bracket slidably coupled to the mounting bracket; and a support arm adapted to be attached to the spa cover, wherein the support arm is pivotably coupled to the slide bracket at a pivot point on the slide bracket.

In yet another exemplary embodiment according to the present invention, a method of removing a spa cover from a top of a spa is provided. The method includes: sliding the spa cover towards a rear end of the spa; folding the spa cover into two substantially equal sections; and rotating the spa cover so as to remove it completely from the top of the spa.

These and other aspects of the invention will be more readily comprehended in view of the discussion herein and accompanying drawings, in which like reference numerals designate like elements.

DETAILED DESCRIPTION

Figure 1:
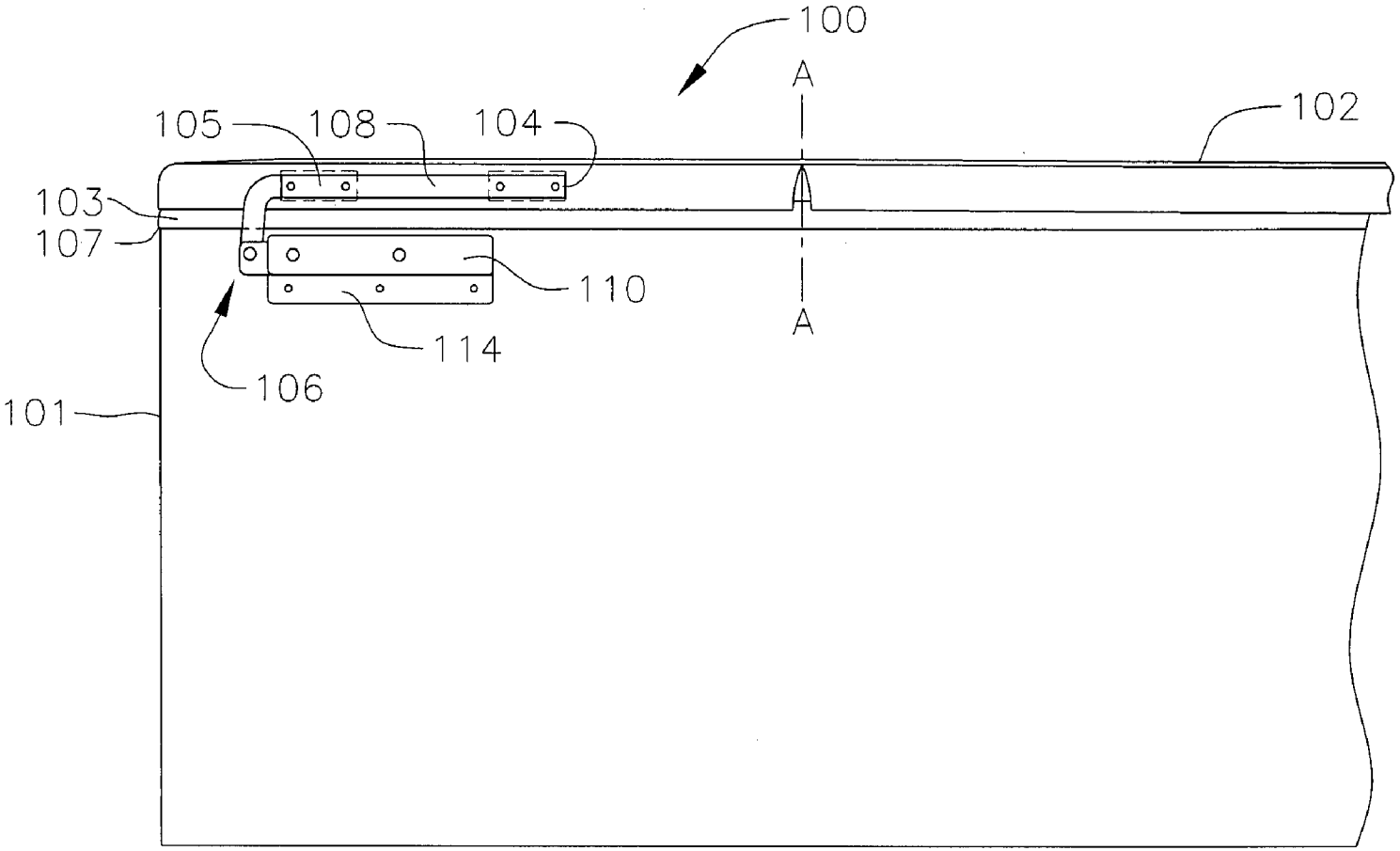
FIG. 1 is a side view of a hinge assembly (in a closed position) that couples a spa cover to a spa in an exemplary embodiment according to aspects of the present invention.

FIG. 1 is a side view of a hinge assembly 106 that couples a spa cover 102 to a spa 100 in an exemplary embodiment according to aspects of the present invention. The spa 100 has a substantially rectangular shape, and includes an outer wood frame 101 surrounding an inner spa 103. The inner spa 103, for example, may be fabricated using fiberglass. In the described exemplary embodiment, the inner spa 103 has a lip 107 that extends over and outside of the outer wood frame 101 around the periphery of the spa 102. In other embodiments, the spa may have a shape other than a substantially rectangular shape.

In FIG. 1, the spa is in a closed position, where the spa cover 102 completely covers the opening of the spa. The spa cover is foldable at a fold line A—A into two substantially rectangular sections that are approximately equal in size. When opening the spa, the spa cover is first folded into two sections, one on top of the other, the folded spa cover is slid towards the rear of the spa to partially open the spa, and is then rotated about the rear edge at the top of the spa to completely open the spa. In other embodiments, the spa cover may have a shape other than a substantially rectangular shape.

The hinge assembly 106 is mounted near the rear edge and on the outer wood frame 101 of the spa when viewed from the left side of the spa. There is provided another hinge assembly on the right side of the spa 100, which is hidden from view in FIG. 1. The right side hinge assembly has substantially the same configuration as the hinge assembly 106, except that the right side hinge assembly when viewed from the right side is a mirror image of the hinge assembly 106. Therefore, the hinge assembly will be described in reference to the left side hinge assembly 106 with an understanding that the right and left side hinge assemblies have substantially the same configuration (but with a mirror image) as each other.

Figure 2:
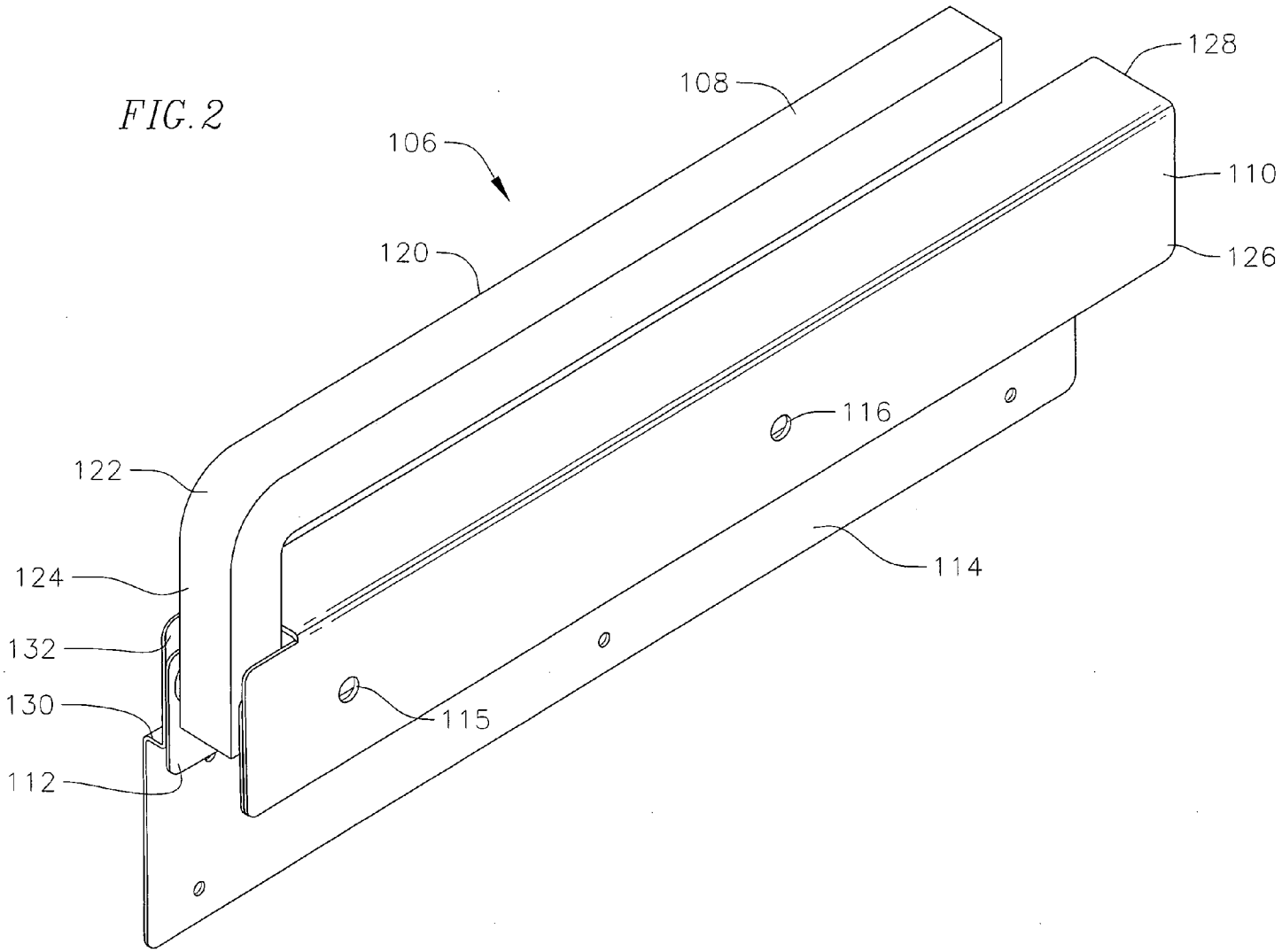
FIG. 2 is a perspective view of the hinge assembly of FIG. 1 in a closed position.
Figure 3:
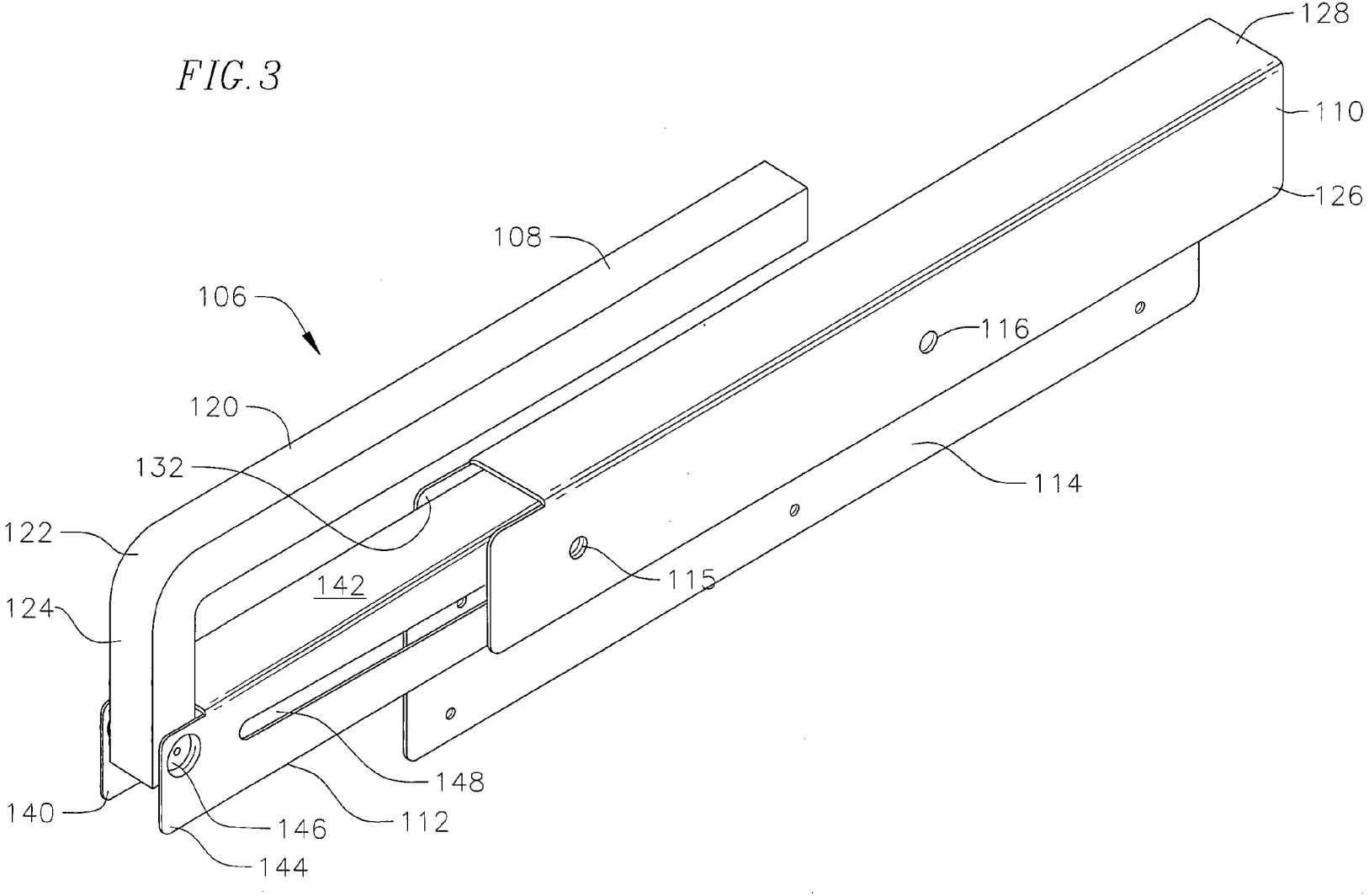
FIG. 3 is a perspective view of the hinge assembly of FIG. 2 in a partially (slid) open position.
Figure 4:
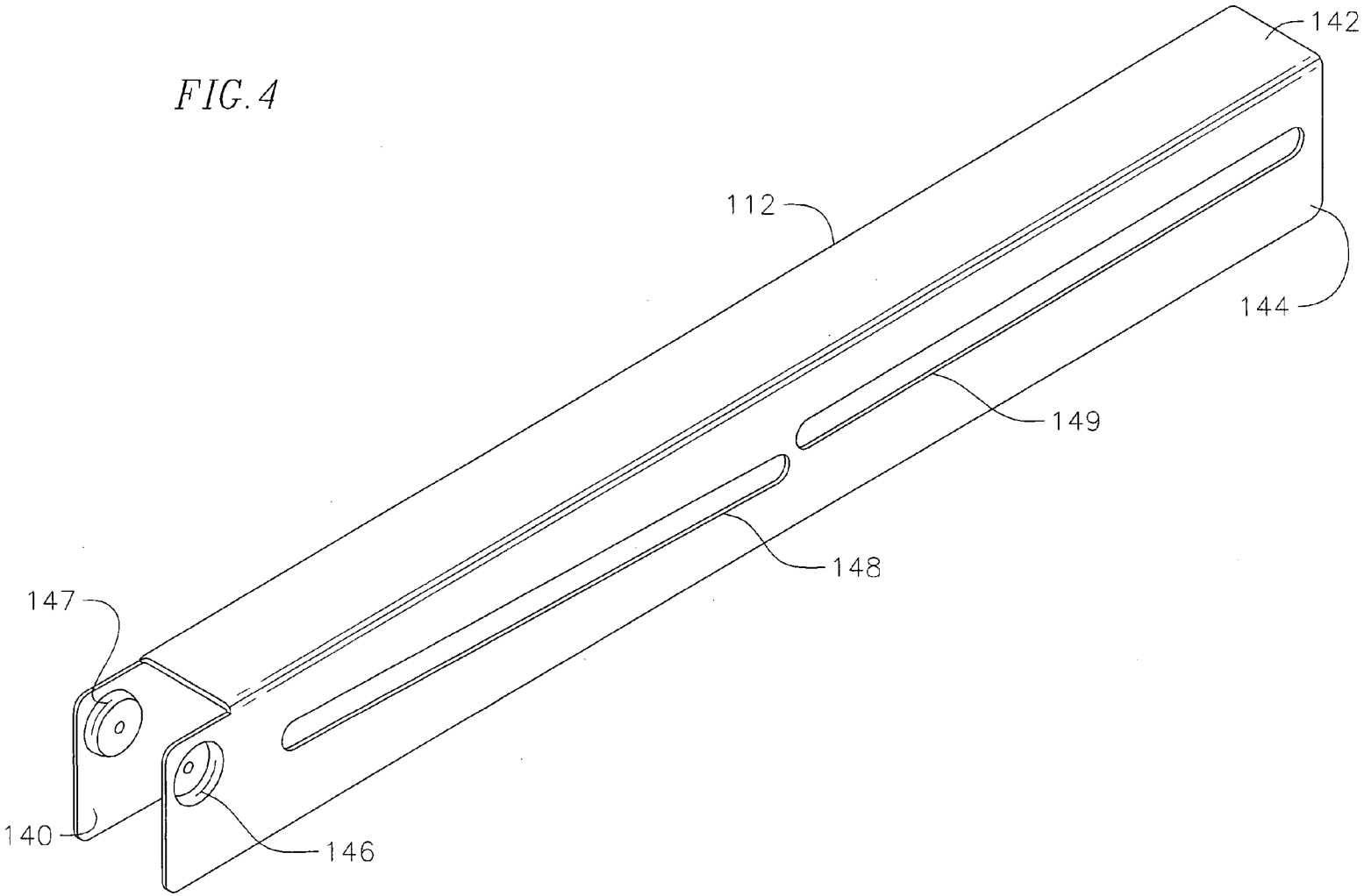
FIG. 4 is a perspective view of a slide bracket of FIGS. 2 and 3.

With reference also to FIGS. 2–4, the hinge assembly 106 includes a support arm 108, a mounting bracket 110 and a slide bracket 112. The support arm 108 is pivotably mounted on the slide bracket 112. It can be seen that the exemplary hinge assembly of FIGS. 2–4 does not include a gas spring or any other spring member. In alternate embodiments, hinge assemblies may also include one or more gas springs and/or other spring members. Such gas spring(s) and/or other spring member(s), for example, may be coupled between the support arm 108 and at least one of the slide bracket 112, the mounting bracket 110 and the wood frame 101.

The support arm 108 has an elongated arm section 120, a short arm section 124 and a connecting member 122 disposed therebetween. The arm sections and the connecting member have a rectangular cross section in the described embodiment, but may have other (e.g., circular) cross-sectional shapes in other embodiments. The connecting member 122 is curved with a convex curvature so that the elongated arm section 120 and the short arm section 124 are substantially perpendicular to one another. In other embodiments, the angle between the arm sections may be different than 90 degrees.

The mounting bracket 110 includes a pair of side plates 126 and 132 that are substantially parallel with one another. The side plates 126 and 132 each have a rectangular shape that is elongated in a horizontal direction. Since the side plate 126 is at an outer position with respect to the side wall of the spa 100, the side plate 126 may be referred to as an outer side plate. Similarly, the side plate 132 may be referred to as an inner side plate.

The respective top edges of the side plates 126 and 132 are connected via a web 128 that runs along most of the length of the top edges of the side plates 126 and 132. At the end towards the rear of the spa, there is a short segment where the web is shorter than the side plates, and the side plates are not connected to the web. The end of the short arm section 124 is situated between the side plates at this short segment when the hinge assembly 106 is in a fully closed position.

The inner side plate 132 is attached at its bottom edge to a narrow horizontal connecting strip 130 that runs along substantially the whole length of the inner side plate.

The mounting bracket 110 also includes a mounting plate 114 that is connected to the edge of the horizontal connecting strip 130 on the side not connected to the inner side plate 132. The mounting plate 114 has a number of holes used together with a fastener (e.g., nails, screws, bolts or the like) for attaching the mounting bracket 110 to the side of the wood frame 101. The horizontal connecting strip 130 allows the inner side plate 132 to abut the lip 107 of the inner spa 103 that protrudes out over the side of the wood frame 101, when the mounting plate 114 is attached to the wood frame 101.

The outer side plate 126 has formed thereon holes 115 and 116 used to slidably mount the slide bracket 112. The slide bracket 112 is supported at least in part by fasteners (not shown) inserted into at least one of the holes 115 and 116 so that it can slide in and out of the mounting bracket 110. The inner side mount 132 may also have similar holes (not shown) formed thereon at locations corresponding to the holes 115 and 116 to slidably couple the slide bracket 112 to the mounting bracket 110.

As can be seen in FIG. 2, the support arm 108 is actually mounted on the slide bracket 112 so that the support arm 108 moves linearly together with the slide bracket as the slide bracket is moved linearly with respect to the mounting bracket 110.

FIG. 3 is a perspective view of the hinge assembly 106 in a partially (slid) open position, and FIG. 4 is a perspective view of the slide bracket 112. It can be seen in FIGS. 3 and 4 that the slide bracket 112 has a configuration similar to that of the mounting bracket 110. In other words, the slide bracket 112 has two parallel slide plates 140 and 144 that are connected via a web 142 that runs along most of the length of the slide plates 140 and 144. Each of the slide plates 140, 144 and the web 142 has a substantially elongated rectangular shape. The slide plate 140 on the spa side of the web 142 may be referred to as an inner slide plate whereas the slide plate 144 on the side away from the spa may be referred to as an outer slide plate.

The outer slide plate 144 has formed thereon a hole 146, which is used to pivotably mount the support arm 108. Similarly, the inner slide plate 140 has a hole 147 for mounting the support arm 108 at a location corresponding to the hole 146. For example, a pin may be inserted through the holes on the slide plates and the short arm section 124 between the slide plates, thereby pivotably holding the support arm 108 on the slide bracket 112.

The slide plate 144 also has formed thereon elongated openings 148 and 149. The elongated opening 148 runs in a primarily horizontal direction along close to one half the length of the slide plate 144 at the end near the hole 146. The elongated opening 149 runs in a generally horizontal direction along close to one half the length of the slide plate 144 at the end away from the hole 146. The slide plate 140 also has formed thereon elongated openings (not shown) that correspond to the elongated openings 148 and 149 of the slide plate 144.

The slide bracket 112 may be slidably coupled with the mounting bracket 110, for example, by inserting a pin through the hole 115 and the elongated opening 148 and another pin through the hole 116 and the elongated opening 149. The elongated openings (now shown) on the inner slide plate 140 also may be coupled with the holes 115 and 116, respectively, using the same respective pins.

It can be seen in FIGS. 3 and 4 that the elongated opening 148 is slanted with respect to the horizontal plane while the elongated opening 149 is substantially parallel to the horizontal plane. This is also the case with the respective corresponding elongated openings on the slide plate 140.

For example, at the end close to the pivot point (i.e., the hole 146) of the support arm 108, the elongated opening is almost at the level of the hole 146. As the elongated opening 148 traverses the slide plate 144 away from the hole 146, it gradually moves in a downward direction. On the other hand, the elongated opening 149 remains substantially parallel to the horizontal plane over its length. Therefore, while the end adjacent to the hole 146 of the slide bracket 112 moves upward as the slide bracket 112 is pulled from the mounting bracket 110, the other end of the slide bracket 112 remains at substantially the same horizontal level.

As the slide bracket 112 is pulled away from the mounting bracket 110, since the end close to the holes 146 and 147 is raised up, the support arm 106 is moved in an upward direction as well as the horizontal direction (towards the back of the spa). Conversely, as the slide bracket 112 is pushed into the mounting bracket 110, the support arm 106 is moved in a downward direction as well as the horizontal direction (towards the front of the spa). Since the spa cover 102 is attached to the support arm, as the support arm is moved up or down vertically, the spa cover will likewise move up or down together with the support arm.

Returning now to FIG. 1, the support arm 108 is fixedly attached to the spa cover 102 at two locations along the length of the spa cover. Both the attachment locations are on only one of the two spa cover sections (e.g., on the spa cover section that is under the other spa cover section when the spa cover is folded) so that the support arm need not be folded in a similar manner when folding the spa cover in two. At each attachment location, two parallel bolts or screws are used to fasten the support arm to the spa cover. In other embodiments, the support arm may be attached at more than two attachment locations on the spa cover section. Further, more or less than two bolts or screws may be used at each attachment location in other embodiments.

To support the attachment of the support arm 108 to the spa cover 102 at two attachment locations, two metal plates 104 and 105 are first mounted on the spa cover 102. In FIG. 1, the metal plates 104 and 105 are shown as rectangles having dotted lines along the left side edge of one of the spa cover sections. They are shown in dotted lines because they are at least partly hidden from view behind the support arm 108.

The metal plates 104 and 105 have a width that is substantially the same as the width of the support arm 108. In other embodiments, the width of the metal plates may be more or less than the width of the support arm 108. Further, a different size and/or number of metal plates (e.g., one long metal plate that runs along the length of one of the sections of the spa cover 102) may be used. A detailed description of installation and operation of the metal plates 104 and 105 is provided below in reference to FIGS. 5 and 6.

Figure 5:
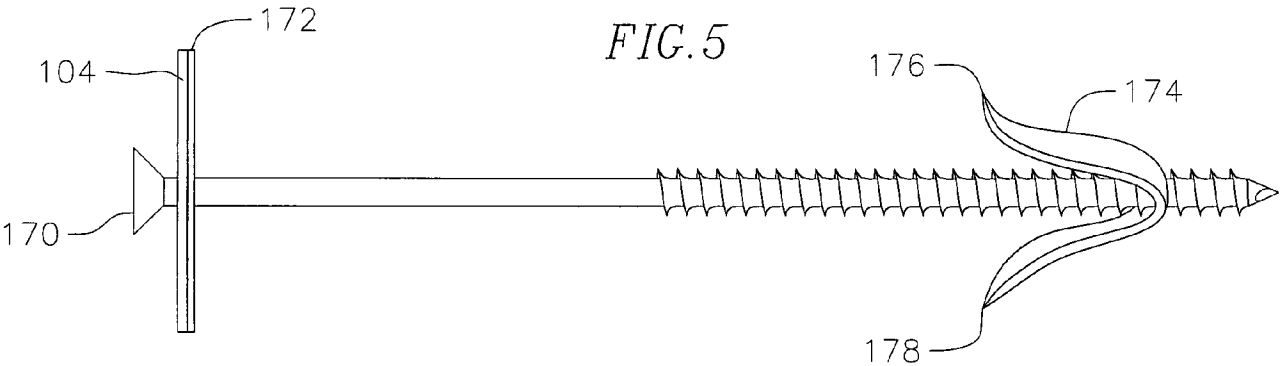
FIG. 5 is a side view of a metal plate assembly in an exemplary embodiment in accordance with aspects of the present invention.

FIG. 5 illustrates a side view of a metal plate assembly in an exemplary embodiment in accordance with aspects of the present invention. The metal plate assembly includes the metal plate 104, a double sided tape 172, a screw 170 and an anchor 174. It should be noted that while the metal plate assembly is described in reference to metal plate 104 of FIG. 1, the metal plate 105 (and any other metal plates used) may have substantially the same configuration.

The metal plate 104 may be formed from aluminum and may have a rectangular shape and size varying, for example, between approximately 1"×4" (2.54 cm×10.16 cm) and approximately 1.75"×2" (4.445 cm×5.08 cm). The metal plate may have other dimensions in other embodiments. Further, the metal plate may have any other suitable shape such as angle, channel and the like. For example, when an angle formed of two adjoining plates is used, one of the plates may be inserted into the spa cover and/or its core. A slit may be preformed on the spa cover and/or the core to accommodate the insertion of that plate of the angle.

The double sided tape 172 may cover one side of the metal plate 104 completely, and is affixed to the metal plate. The adhesive on the side away from the metal plate should remain covered until the metal plate (and the double sided tape) is ready to be affixed to a spa cover. The double sided tape 172 may, for example, be a 0.030 heavy duty double sided tape.

The screw 170, for example, may be a flat head Phillips drive drywall screw or any other suitable screw. The screw 170 may, for example, have a length of approximately 6" (15.24 cm), and may be coarsely threaded. The anchor 174 is formed from an elongated metal strip that is approximately 2.5" (6.35 cm) in length. The anchor 174 is bent about its middle to form an elongated "U" shape. The anchor 174 has a hole about its middle that can be used to engage the thread on the screw 170. Hence, the anchor 174 may be described as an U-shaped member having a base with hole and two elongated wings. The anchor 174 has a pointed tip at both ends 176 and 178 (e.g., of the two wings), so that the wings can penetrate the material into which the anchor is embedded. The anchor may have other suitable shapes in other embodiments. The anchor 174 is deformable so that it can at least partly be unbent during the installation process.

Figure 6:
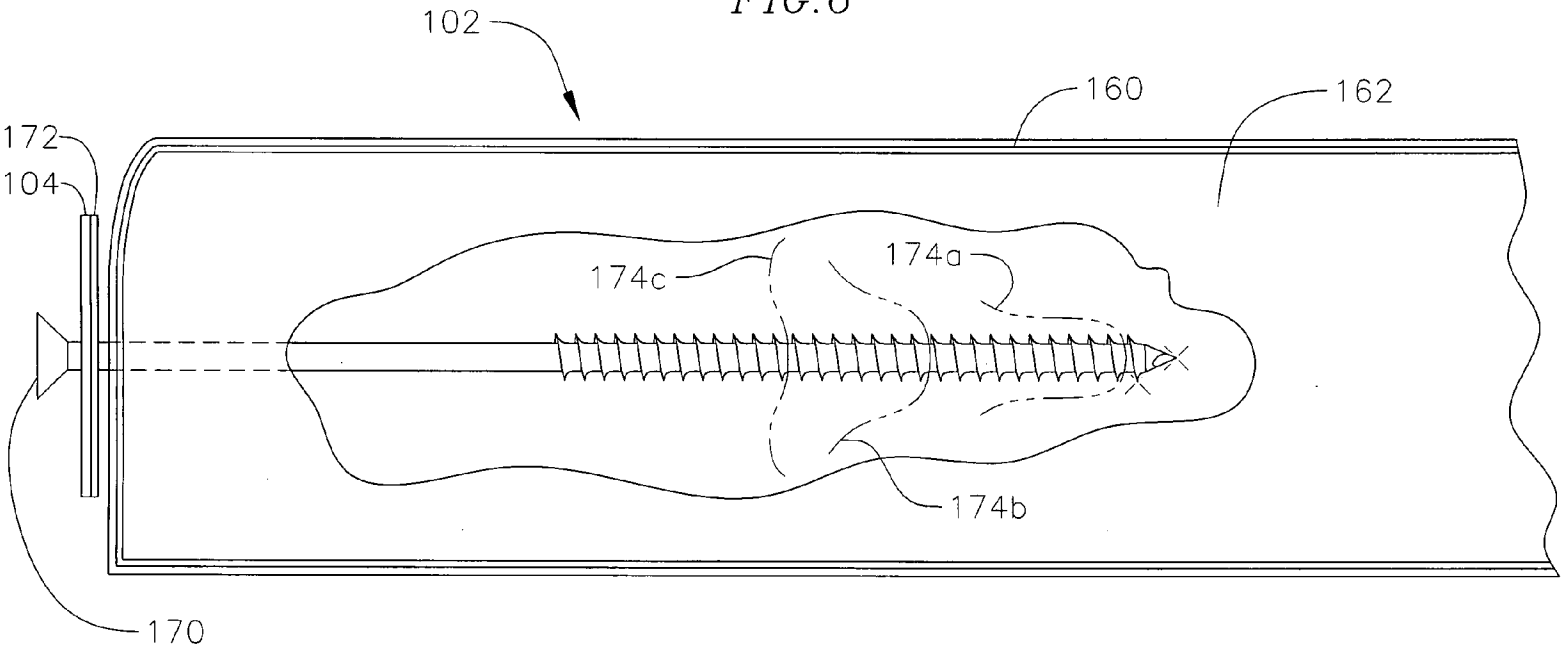
FIG. 6 illustrates the metal plate assembly of FIG. 5 being mounted on a spa cover.

FIG. 6 illustrates the metal plate assembly of FIG. 5 being mounted on a spa cover 102. The spa cover 102 has a core 162 (which may be formed from a solid block of foam) covered by a cover 160 (which may be formed from vinyl). In other embodiments, other suitable materials other than foam and/or vinyl may be used to fabricate the core and/or the cover, respectively. It should be noted that while the installation of the metal plate assembly is described in reference to metal plate 104 of FIG. 1, the metal plate 105 (and any other metal plates used) may be installed in substantially the same manner.

During installation, the sticky portion not affixed to the metal plate of the double sided tape 172 should first be exposed so that the double sided tape 172, and therefore the metal plate 104, can be affixed on the cover 160. Then, the screw 170 is nailed (i.e., pounded in and not screwed) through a hole on the metal plate 104 and the cover 160 into the core 162 without removing the cover 160. This way, the steps of removing the cover and then reinserting the core into the cover may be avoided. In other embodiments, however, the cover may be removed to install the metal plates directly on the core. Since the anchor 174 engages the thread of the screw 170, the anchor is inserted into the core 162 together with the screw 170.

The metal plate may be affixed to the cover 160 via the double sided tape 172 at any time before, during or after nailing the screw 170 into the core 162. The adhesive on the double sided tape 172 may form a seal around the opening on the cover 160 formed by driving in the screw 170 so as to prevent moisture from entering inside the cover 160.

With the metal plate and the screw (and the anchor) in place, the screw is rotated to attach it firmly to the core 162. That is, at the time of inserting the screw into the core 162, the anchor 174 has an outline and relative location similar to that of a dotted outline 174*a*. As the screw is rotated, the anchor 174 travels towards the head of the screw 170 since the hole at the center of the anchor is engaging the thread of the screw 170. Moving towards the screw head, the anchor 174 is deformed since its movement is resisted by the core 162, which may be a solid block of foam material. Hence, during the process, the anchor has an outline and relative position 174*b*, for example, where the anchor has partially unbent wings due to the resistance provided by the core 162. As can be imagined, it would be harder and harder to turn the screw 170 since the resistance provided by the core 162 increases. Finally, the anchor may have an outline and relative position 174*c* when the screw is finally firmly anchored within the core 162, and the wings of the anchor 174 are further spread out.

Figure 7:
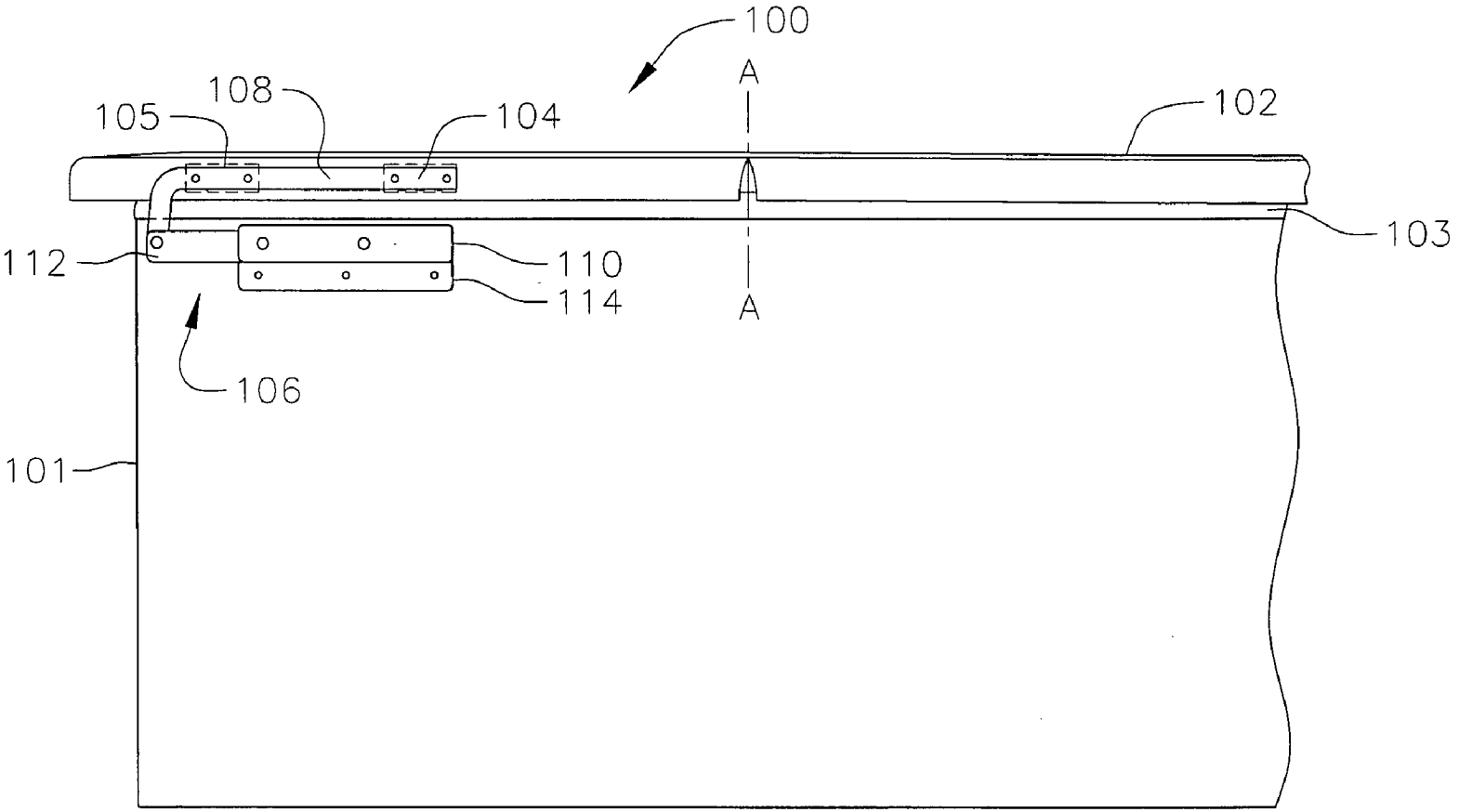
FIG. 7 is a side view of the hinge assembly (in a partially (slid) open position), spa cover and spa of FIG. 1.

FIG. 7 is a side view of the hinge assembly 106 (in a partially (slid) open position), spa cover 102 and spa 100 of FIG. 1. It can be seen it FIG. 7 that the slide bracket 112 has been extended towards the back of the spa. In other words, the slide bracket 112 is partially pulled out of the mounting bracket 110. FIG. 7 illustrates a first step in the operation of the hinge assembly in the described exemplary embodiment, where the spa cover 102 is first slid rearward prior to folding or rotating the spa cover. In other embodiments, the spa cover 102 may be folded in two prior to sliding it backward.

As discussed in reference to FIG. 3, the support arm 108 is linearly moved together with the slide bracket 112 as the slide bracket is moved horizontally rearward and vertically upward simultaneously. Since the spa cover 102 is attached to the support arm 108, the end of the spa cover is slightly lifted up off the spa at the rear edge of the spa 100 as the support arm 108 is moved upward vertically. As described in reference to FIG. 3, this is because of the configuration of the elongated openings on the slide plates that are inclined (or slanted) upward towards the rear edge of the spa. With the rear edge of the spa cover pushed behind the spa and slightly lifted up, it is easier to rotate the spa cover after folding the spa cover in half.

Figure 8:
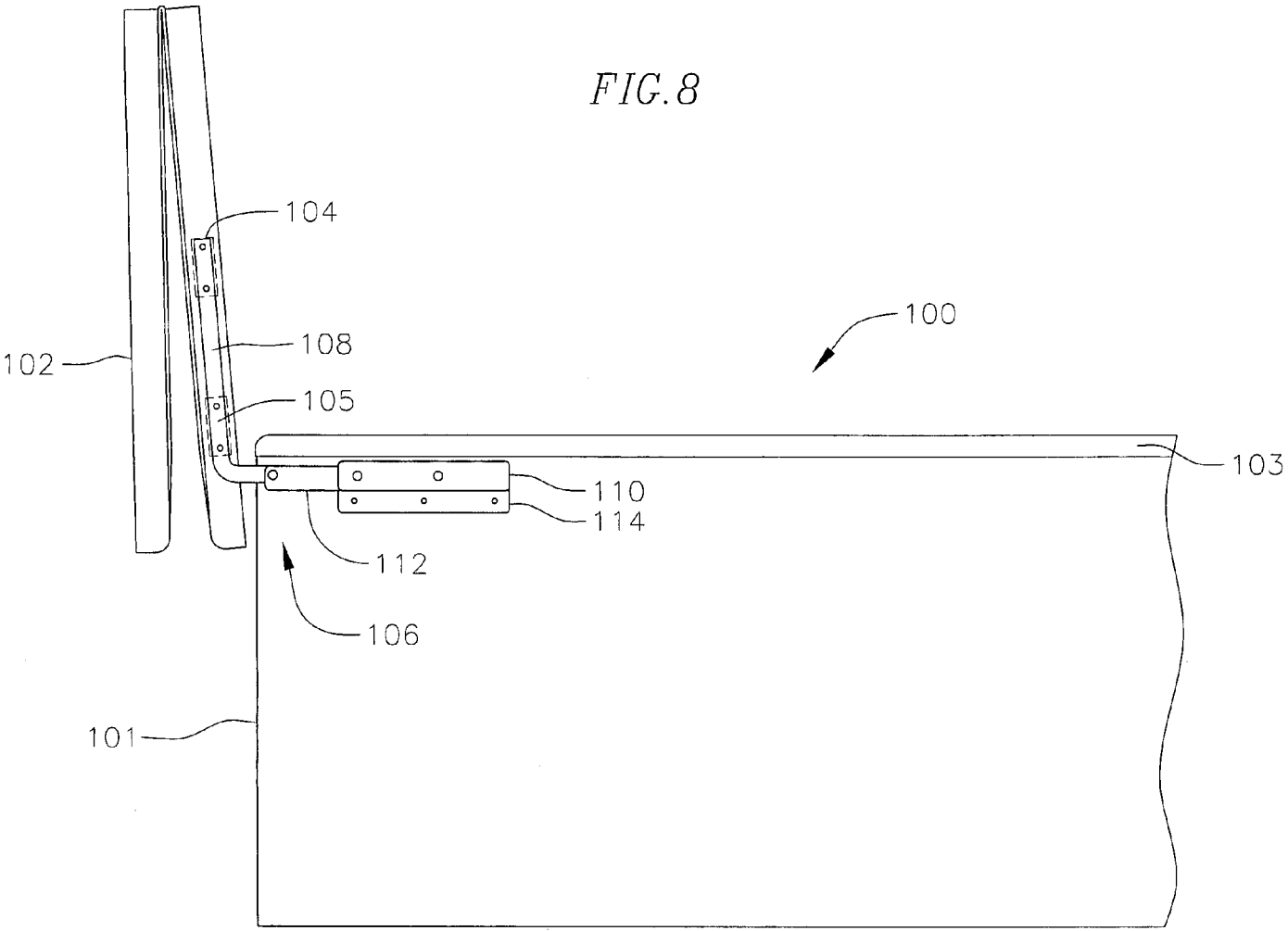
FIG. 8 is a side view of the hinge assembly (in a fully (slid and rotated) open position), spa cover, and spa of FIG. 1.

FIG. 8 is a side view of the spa 100 in a fully open position. The spa cover 102 is folded in half, and has been rotated to fully open the spa. It can be seen that the slide bracket 112 has been extended from the mounting bracket 110 towards the rear edge of the spa. It can be seen in FIG. 8 that the spa cover 102 at least partially drops below the top of the spa 100. Since the spa cover 102 is first pushed back behind the rear edge of the spa, the resistance to rotation is reduced, allowing the spa cover to be rotated with less force. Further, without the spa cover slightly lifted up and/or pushed backward, the spa cover may jamb during its rotation about the pivot axis on the support arm 108.

Figure 9:
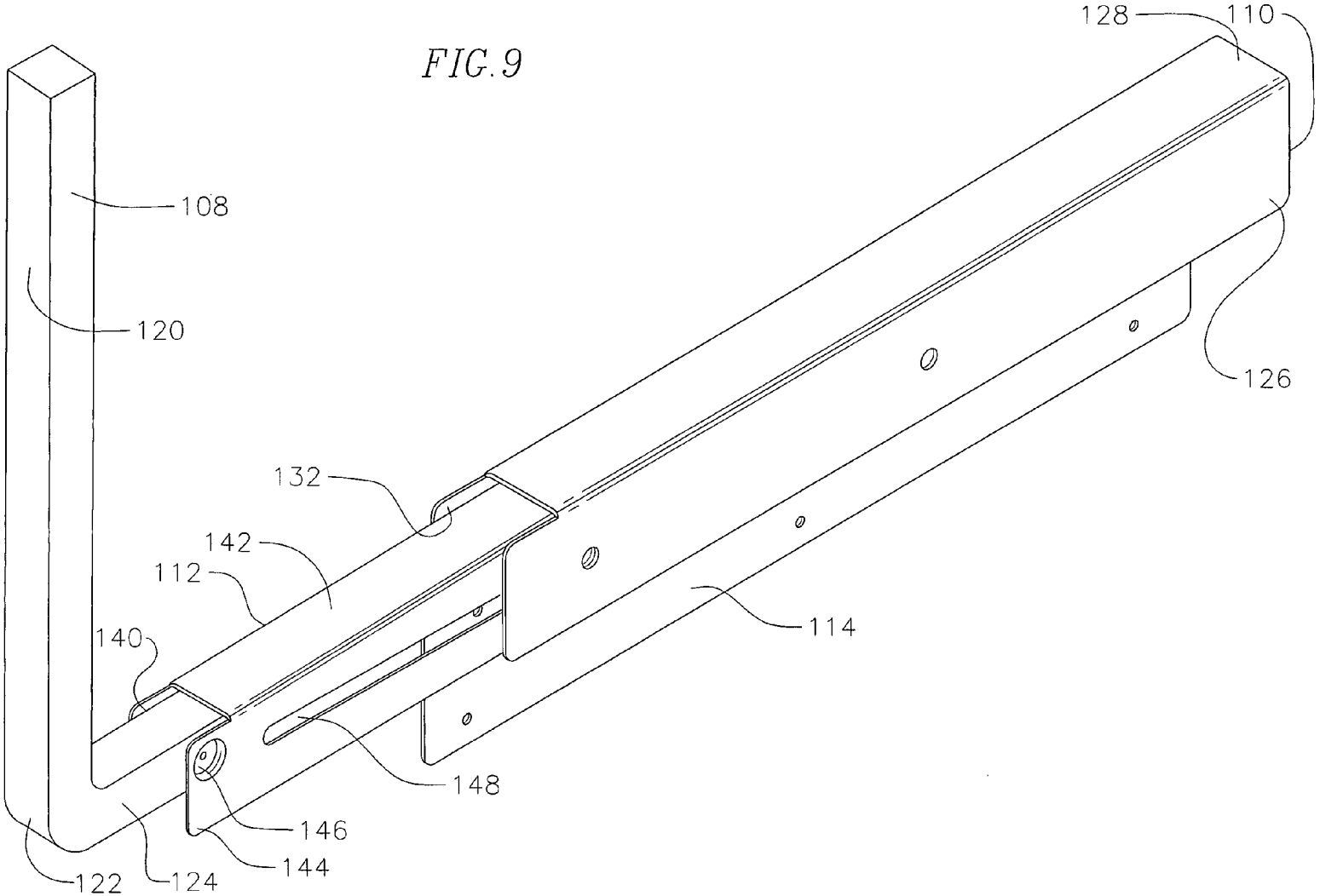
FIG. 9 is a perspective view of the hinge assembly of FIG. 2 in a fully (slid and rotated) open position.

FIG. 9 shows a perspective view of the hinge assembly with the spa cover in a fully open position. The fully open hinge assembly 106 of FIG. 9 is in similar configuration as the partially open hinge assembly 106 of FIG. 3 except that the support arm 108 in FIG. 9 has been rotated about the pivot axis on the slide bracket 112. The slide bracket 112 is partially extended out of the mounting bracket 110. The support arm 108 has been rotated counterclockwise approximately 90 degrees about the pivot axis that is aligned with the hole 146, with respect to the support arm 108 of FIG. 3.

The spa cover is closed in a manner that is a reverse of the opening process. First, the spa cover is rotated clockwise so that the spa cover partially covers at least a portion of the rear half of the spa. Then the spa cover is slid towards the front edge of the spa either by pushing from behind the spa and/or pulling from the front and/or sides of the spa. The spa cover may be unfolded either prior to or after the spa cover has been slid back into a fully closed position.

It will be appreciated by those of ordinary skill in the art that the invention can be embodied in other specific forms without departing from the spirit or essential character thereof. The present invention is therefore considered in all respects to be illustrative and not restrictive. The scope of the invention is indicated by the appended claims, and all changes that come within the meaning and range of equivalents thereof are intended to be embraced therein.

The invention claimed is:

1. The hinge assembly of claim 3, wherein the rear end of the slide bracket is moved in an upward direction as the slide bracket is slidably extended from the mounting bracket.

2. A hinge assembly for coupling a spa cover to a spa, comprising:

a mounting bracket adapted to be installed near a top of the spa;

a slide bracket slidably coupled to the mounting bracket; and a support arm adapted to be attached to the spa cover, wherein the support arm is pivotably coupled to the slide bracket at a pivot point on the slide bracket, and wherein the support arm comprises:

an elongated member adapted to be attached along a side of the spa cover;

a short member, which is pivotably coupled to the slide bracket; and a connecting member between the elongated member and the short member, said connecting member having a curvature such that the short member is substantially perpendicular to the elongated member.

3. A hinge assembly for coupling a spa cover to a spa, comprising:

a mounting bracket adapted to be installed near a top of the spa;

a slide bracket slidably coupled to the mounting bracket, the slide bracket having a front end and a rear end; and a support arm adapted to be fixedly attached to the spa cover, wherein the support arm is pivotably coupled to the slide bracket at a pivot point near the rear end of the slide bracket, wherein the slide bracket is adapted to slide with respect to the mounting bracket independently of a pivotal movement of the support arm about the pivot point on the slide bracket, wherein the mounting bracket comprises two side plates connected via a web, wherein at least one of the side plates has formed thereon at least one hole used to slidably couple the slide bracket to the mounting bracket, and wherein the slide bracket comprises two slide plates connected via another web, wherein at least one of the slide plates has formed thereon an elongated opening coupled to said at least one hole via a pin to slidably couple the slide bracket to the mounting bracket, wherein the elongated opening is inclined with a first vertical level of the opening close to the pivot point being higher than a second vertical level of the opening away from the pivot point, thereby enabling the end near the pivot point to be moved in the upward direction as the slide bracket is slidably extended from the mounting bracket.

4. A spa system comprising:

a spa;

a foldable spa cover having at least two sections;

a hinge assembly for coupling the spa cover to the spa, said hinge assembly comprising:

a mounting bracket installed near a top of the spa;

a slide bracket slidably coupled to the mounting bracket, the slide bracket having a front end and a rear end; and a support arm fixedly attached to the spa cover, wherein the support arm is pivotably coupled to the slide bracket at a pivot point near the rear end of the slide bracket, wherein the slide bracket is adapted to slide with respect to the mounting bracket independently of a pivotal movement of the support arm about the pivot point on the slide bracket, such that the spa cover is adapted to slide rearward first and then rotated when the support arm is rotated about the pivot point.

wherein the mounting bracket comprises two side plates connected via a web, wherein at least one of the side plates has formed thereon at least one hole used to slidably couple the slide bracket to the mounting bracket, and wherein the slide bracket comprises two slide plates connected via another web, wherein at least one of the slide plates has formed thereon an elongated opening coupled to said at least one hole via a pin to slidably couple the slide bracket to the mounting bracket, wherein the elongated opening is inclined with a first vertical level of the opening close to the pivot point being higher than a second vertical level of the opening away from the pivot point, thereby enabling the rear end to be moved in an upward direction as the slide bracket is slidably extended from the mounting bracket.

5. The spa system of claim 4, wherein the support arm is attached to the spa cover via a metal plate disposed on an outside surface of the spa cover.

6. The spa system of claim 5, wherein the metal plate is affixed to the spa cover via a double sided tape.

7. The spa system of claim 6, wherein the metal plate has a hole formed thereon, wherein a screw is inserted through the hole into the spa cover, and wherein the screw is anchored in the spa cover by rotating the screw.

8. The spa system of claim 7, further comprising a deformable anchor engaged with the screw, and wherein the deformable anchor is deformed and embedded inside the spa cover as the screw is rotated.

* * * * *